US007198207B2

(12) United States Patent
Goenka et al.

(10) Patent No.: US 7,198,207 B2
(45) Date of Patent: Apr. 3, 2007

(54) LOW PRESSURE FUEL INJECTOR NOZZLE

(75) Inventors: Lakhi N. Goenka, Ann Arbor, MI (US); Jeffrey Paul Mara, Livonia, MI (US); David Lee Porter, Westland, MI (US); David Ling-Shun Hung, Novi, MI (US); John Stefanski, Pinckney, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 2 days.

(21) Appl. No.: 10/983,017

(22) Filed: Nov. 5, 2004

(65) Prior Publication Data

US 2006/0097079 A1 May 11, 2006

(51) Int. Cl.
*F02M 61/00* (2006.01)

(52) U.S. Cl. ..... 239/533.12; 239/494; 239/497; 239/596; 239/598

(58) Field of Classification Search ..... 239/88–96, 239/533.2, 533.11, 533.12, 533.14, 589, 593, 239/592, 596, 597, 598, 494, 497
See application file for complete search history.

(56) References Cited

U.S. PATENT DOCUMENTS

| | | | |
|---|---|---|---|
| 3,326,191 | A | 6/1967 | Berlyn |
| 4,018,387 | A | 4/1977 | Erb et al. |
| 4,106,702 | A | 8/1978 | Gardner et al. |
| 4,139,158 | A | 2/1979 | Uehida |
| 4,254,915 | A | 3/1981 | Muller |
| 4,275,845 | A | 6/1981 | Muller |
| 4,346,848 | A | 8/1982 | Malcolm |
| 4,540,126 | A | 9/1985 | Yoneda et al. |
| 4,650,122 | A | 3/1987 | Kienzle et al. |
| 4,666,088 | A | 5/1987 | Krauss et al. |
| 4,801,095 | A | 1/1989 | Banzhaf et al. |
| 4,907,748 | A | 3/1990 | Gardner et al. |
| 5,163,621 | A | 11/1992 | Kato et al. |
| 5,201,806 | A | 4/1993 | Wood |
| 5,244,154 | A | 9/1993 | Buchholz et al. |
| 5,344,081 | A | 9/1994 | Wakeman |
| 5,383,597 | A | 1/1995 | Sooriakumar et al. |
| 5,402,943 | A | 4/1995 | King et al. |
| 5,449,114 | A | 9/1995 | Wells et al. |
| 5,497,947 | A | 3/1996 | Potz et al. |
| 5,533,482 | A | 7/1996 | Naitoh |
| 5,553,790 | A | 9/1996 | Findler |
| 5,570,841 | A | 11/1996 | Pace et al. |
| 5,636,796 | A | 6/1997 | Oguma |
| 5,662,277 | A | 9/1997 | Taubitz et al. |
| 5,685,485 | A | 11/1997 | Mock et al. |
| 5,685,491 | A | 11/1997 | Marks et al. |

(Continued)

FOREIGN PATENT DOCUMENTS

| | | | |
|---|---|---|---|
| EP | 0 551 633 | A1 | 7/1993 |

(Continued)

*Primary Examiner*—Steven J. Ganey
(74) *Attorney, Agent, or Firm*—Brinks Hofer Gilson & Lione

(57) ABSTRACT

A nozzle for a low pressure fuel injector that improves the control and size of the spray angle, as well as enhances the atomization of the fuel delivered to a cylinder of an engine.

21 Claims, 3 Drawing Sheets

U.S. PATENT DOCUMENTS 5,716,001 A 2/1998 Wakeman et al.
5,716,009 A 2/1998 Ogihara et al.
5,762,272 A 6/1998 Tani et al.
5,911,366 A 6/1999 Maier et al.
5,915,352 A 6/1999 Okamoto et al.
5,924,634 A 7/1999 Arndt et al.
5,934,571 A 8/1999 Schmidt et al.
6,029,913 A 2/2000 Stroia et al.
6,045,063 A 4/2000 Koike et al.
6,050,507 A 4/2000 Holzgrefe et al.
6,092,743 A 7/2000 Shibata et al.
6,102,299 A 8/2000 Pace et al.
6,168,094 B1 1/2001 Schatz et al.
6,168,095 B1 1/2001 Seitter et al.
6,176,441 B1 1/2001 Munezane et al.
6,230,992 B1 * 5/2001 Arndt et al. ..... 239/585.1
6,257,496 B1 7/2001 Wyant
6,273,349 B1 8/2001 Fischbach et al.
6,296,199 B1 10/2001 Noller et al.
6,308,901 B1 10/2001 Nitkiewicz et al.
6,330,981 B1 12/2001 Nally, Jr. et al.
6,394,367 B2 5/2002 Munezane et al.
6,405,945 B1 6/2002 Dobrin
6,439,482 B2 8/2002 Hosoyama et al.
6,439,484 B2 8/2002 Harata et al.
6,494,388 B1 12/2002 Mueller et al.
6,499,674 B2 12/2002 Ren et al.
6,502,769 B2 1/2003 Imoehl
6,513,724 B1 2/2003 Joseph et al.
6,520,145 B2 2/2003 Hunkert
6,533,197 B1 3/2003 Takeuchi et al.
6,547,183 B2 4/2003 Farnsworth
6,578,778 B2 6/2003 Koizumi et al.
6,581,574 B1 6/2003 Moran et al.
6,616,072 B2 9/2003 Harata et al.
6,626,381 B2 9/2003 Parrish
6,644,565 B2 11/2003 Hockenberger
6,666,388 B2 12/2003 Ricco
6,669,103 B2 12/2003 Tsai
6,669,116 B2 12/2003 Iwase
6,685,112 B1 2/2004 Hornby et al.
6,695,229 B1 2/2004 Heinbuch et al.
6,705,274 B2 3/2004 Kubo
6,708,904 B2 3/2004 Itatsu
6,708,905 B2 3/2004 Borissov et al.
6,708,907 B2 3/2004 Fochtman et al.
6,712,037 B2 3/2004 Xu
6,719,223 B2 * 4/2004 Yukinawa et al. ..... 239/584
6,722,340 B1 4/2004 Sukegawa et al.
6,739,525 B2 5/2004 Dantes et al.
6,742,727 B1 6/2004 Peterson, Jr.
6,758,420 B2 7/2004 Arioka et al.
6,764,033 B2 7/2004 Dantes et al.
6,766,969 B2 7/2004 Haltiner, Jr. et al.
6,783,085 B2 8/2004 Xu
6,817,545 B2 * 11/2004 Xu ..... 239/533.12
6,848,636 B2 * 2/2005 Munezane et al. ..... 239/533.12
6,921,022 B2 7/2005 Nally et al.
6,929,196 B2 * 8/2005 Togashi et al. ..... 239/533.14
6,966,499 B2 11/2005 Nally et al.
2001/0017325 A1 8/2001 Harata et al.
2002/0008166 A1 1/2002 Fukaya et al.
2002/0092929 A1 7/2002 Arimoto
2002/0144671 A1 10/2002 Shiraishi et al.
2002/0170987 A1 11/2002 Aoki et al.
2003/0127540 A1 7/2003 Xu
2003/0127547 A1 7/2003 Nowak
2003/0141385 A1 7/2003 Xu
2003/0141387 A1 7/2003 Xu
2003/0173430 A1 9/2003 Spencer
2003/0234005 A1 12/2003 Sumisha et al.
2004/0050976 A1 3/2004 Kitamura
2004/0060538 A1 4/2004 Togashi et al.
2004/0104285 A1 * 6/2004 Okamoto et al. ..... 239/533.12
2004/0129806 A1 7/2004 Dantes et al.

FOREIGN PATENT DOCUMENTS

EP 0 611 886 B1 12/1998
GB 2 232 203 A 12/1990
JP 2-19654 1/1990
JP 5-280442 1/1993
JP 6-221163 8/1994
JP 2001-046919 2/2001
WO WO 93/04277 3/1993
WO WO 93/20349 10/1993
WO WO 95/04881 2/1995

* cited by examiner

LOW PRESSURE FUEL INJECTOR NOZZLE

FIELD OF THE INVENTION

The present invention relates generally to fuel injectors for automotive engines, and more particularly relates to fuel injector nozzles capable of atomizing fuel at relatively low pressures.

BACKGROUND OF THE INVENTION

Stringent emission standards for internal combustion engines suggest the use of advanced fuel metering techniques that provide extremely small fuel droplets. The fine atomization of the fuel not only improves emission quality of the exhaust, but also improves the cold weather start capabilities, fuel consumption and performance. Typically, optimization of the droplet sizes dependent upon the pressure of the fuel, and requires high pressure delivery at roughly 7 to 10 MPa. However, a higher fuel delivery pressure causes greater dissipation of the fuel within the cylinder, and propagates the fuel further outward away from the injector nozzle. This propagation makes it more likely that the fuel spray will condense on the walls of the cylinder and the top surface of the piston, which decreases the efficiency of the combustion and increases emissions.

To address these problems, a fuel injection system has been proposed which utilizes low pressure fuel, define herein as generally less than 4 MPa, while at the same time providing sufficient atomization of the fuel. One exemplary system is found in U.S. Pat. No. 6,712,037, commonly owned by the Assignee of the present invention, the disclosure of which is hereby incorporated by reference in its entirety. Generally, such low pressure fuel injectors employ sharp edges at the nozzle orifice for atomization and acceleration of the fuel. However, the relatively low pressure of the fuel and the sharp edges result in the spray being difficult to direct and reduces the range of the spray. More particularly, the spray angle or cone angle produced by the nozzle is somewhat more narrow. At the same time, additional improvement to the atomization of the low pressure fuel would only serve to increase the efficiency and operation of the engine and fuel injector.

Accordingly, there exists a need to provide a fuel injector having a nozzle design capable of sufficiently injecting low pressure fuel while increasing the control and size of the spray angle, as well as enhancing the atomization of the fuel.

BRIEF SUMMARY OF THE INVENTION

One embodiment of the present invention provides a nozzle for a low pressure fuel injector which improves spray angle and enhances the atomization of fuel delivered to a cylinder of an engine. The nozzle generally comprises a nozzle body and a metering plate. The nozzle body defines a valve outlet and a longitudinal axis. The metering plate is connected to the nozzle body and is in fluid communication with the valve outlet. The metering plate has a bottom wall defined in a nozzle cavity receiving fuel from the valve outlet. The metering plate defines a plurality of exit cavities receiving fuel from the nozzle cavity. Each exit cavity is radially spaced from the longitudinal axis and is oriented along a radial axis. Each exit cavity meets the nozzle cavity at an exit orifice. Each exit orifice has a leading edge and a trailing edge. The trailing edge is spaced radially outwardly from the leading edge. The leading edge extends a distance larger than a distance spanned by the trailing edge.

According to more detailed aspects, the leading edge extends generally perpendicular to the radial axis. Each exit orifice is symmetrical about a symmetry axis and the symmetry axis is aligned with the radial axis. Preferably, at least one exit orifice is either triangular, trapezoidal or oblong.

Another embodiment of the present invention provides a nozzle generally comprising a nozzle body and a metering plate. In this embodiment, each exit orifice has a leading edge and a trailing edge, wherein a portion of the bottom wall in the area adjacent the leading edge is angled. The angled portion adjacent the leading edge may be angled downwardly or upwardly. As such, the angled portion adjacent the leading edge is angled to relative to the remainder of the bottom wall, and is preferably angled by about 20 to 30 degrees. Preferably, the trailing edge is positioned above or below the leading edge. Thus, the exit orifice exists in a plane non-parallel to the plane of the remainder of the bottom wall.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
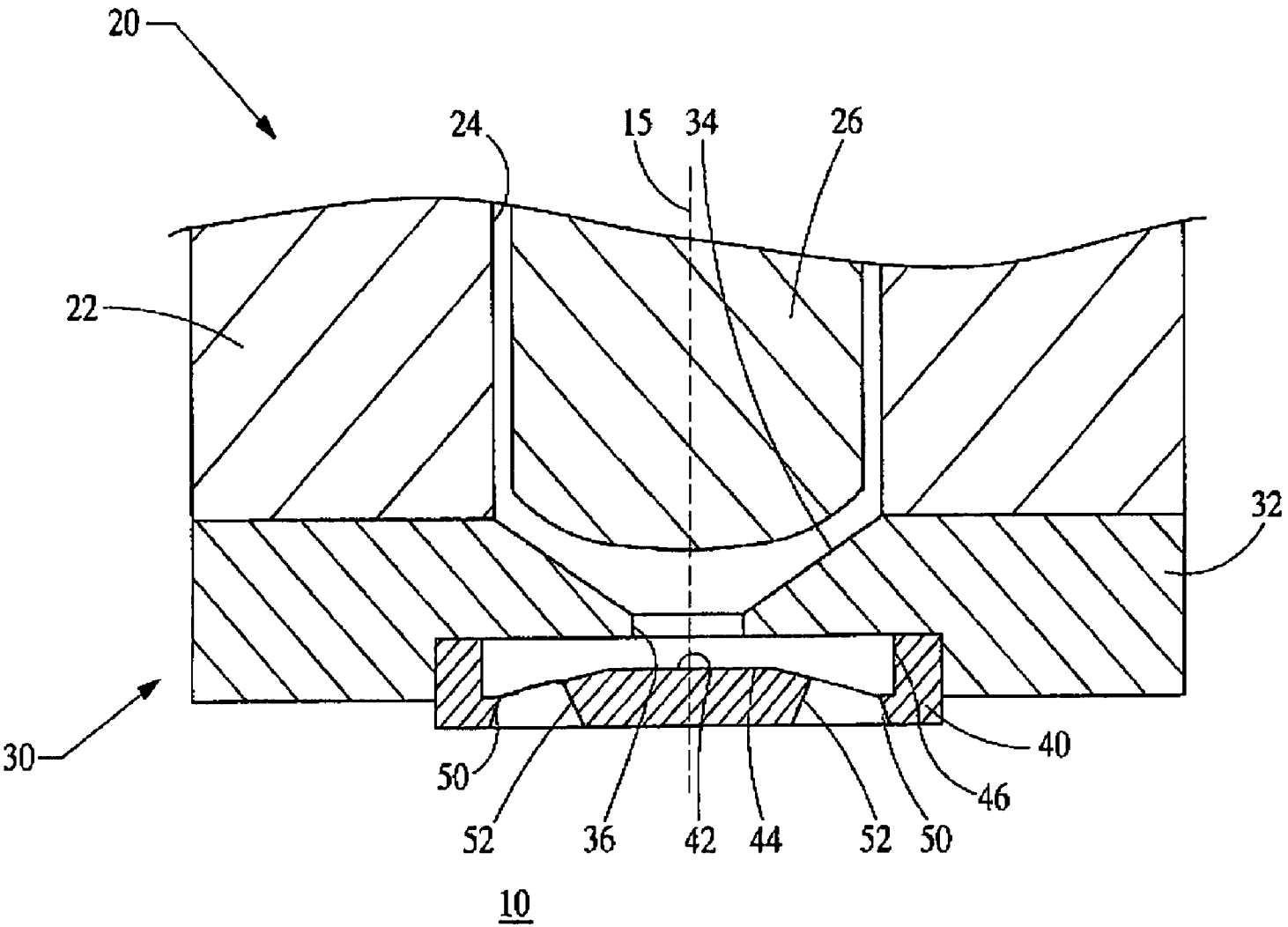
FIG. 1 is a cross-sectional view, partially cut-away, of a nozzle for a low pressure fuel injector constructed in accordance with the teachings of the present invention.

Turning now to the figures, FIG. 1 depicts a cross-sectional of a nozzle 20 constructed in accordance with the teachings of the present invention. The nozzle 20 is formed at a lower end of a low pressure fuel injector which is used to deliver fuel to a cylinder 10 of an engine, such as an internal combustion engine of an automobile. An injector body 22 defines an internal passageway 24 having a needle 26 positioned therein. The injector body 22 defines a longitudinal axis 15, and the internal passageway 24 extends generally parallel to the longitudinal axis 15. A lower end of the injector body 22 defines a nozzle body 32. It will be recognized by those skilled in the art that the injector body 22 and nozzle body 32 may be integrally formed, or alternatively the nozzle body 32 may be separately formed and attached to the distal end of the injector body 22 by welding or other well known techniques.

In either case, the nozzle body 32 defines a valve seat 34 leading to a valve outlet 36. The needle 26 is translated longitudinally in and out of engagement with the valve seat 34 preferably by an electromagnetic actuator or the like. In this manner, fuel flowing through the internal passageway 24 and around the needle 26 is either permitted or prevented from flowing to the valve outlet 36 by the engagement or disengagement of the needle 26 and valve seat 34.

The nozzle 20 further includes a metering plate 40 which is attached to the nozzle body 32. It will be recognized by those skilled in the art that the metering plate 40 may be integrally formed with the nozzle body 32, or alternatively may be separately formed and attached to the nozzle body 32 by welding or other well known techniques. In either case, the metering plate 40 defines a nozzle cavity 42 receiving fuel from the valve outlet 36. The nozzle cavity 42 is generally defined by a bottom wall 44 and a side wall 46 which are formed into the metering plate 40. The metering plate 40 further defines a plurality of exit cavities 50 receiving fuel from the nozzle cavity 42. Each exit cavity 50 is radially spaced from the longitudinal axis 15 and meets the nozzle cavity 42 at an exit orifice 52.

Figure 2:
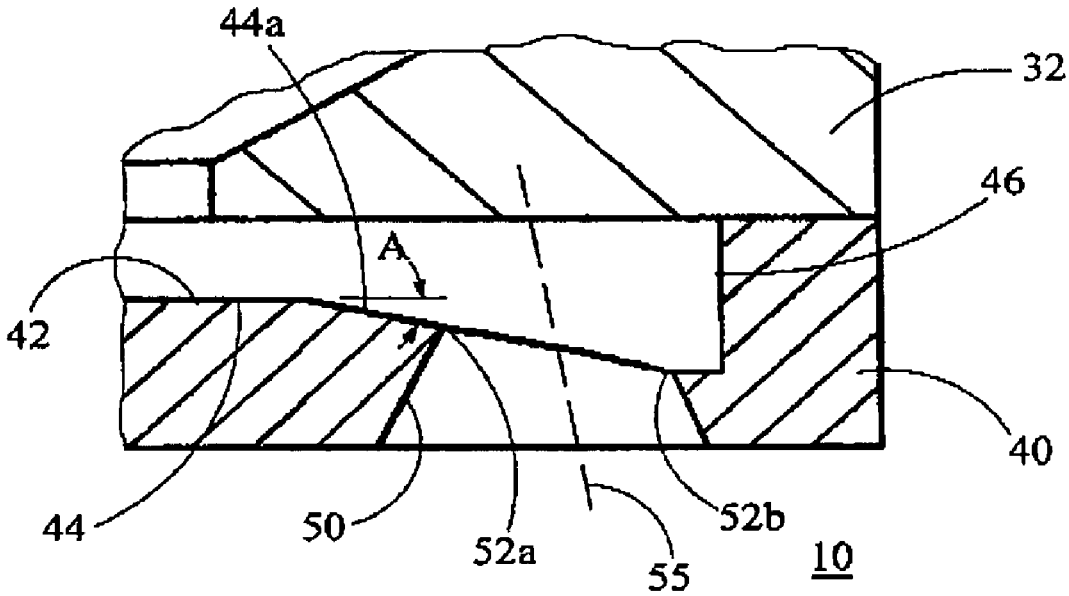
FIG. 2 is an enlarged cross-sectional view, partially cut-away, of the nozzle depicted in FIG. 1.

As best seen in FIG. 2, the metering plate 40 has been uniquely designed to enhance the spray angle and atomization of the fuel being delivered to the engine cylinder 10. The exit cavity 50 generally includes a leading edge 52*a* and a trailing edge 52*b*. The trailing edge 52*b* is spaced radially outwardly from the leading edge 52*a*. A portion of the bottom wall 44*a* in the area adjacent the leading edge 52*a* is angled. As shown in FIG. 2 the angled portion 44*a* is angled downwardly an angle A relative to the remainder of the bottom wall 44, and namely the radially inward portion of the bottom wall 44. Preferably, the angled portion 44*a* is angled about 20 to 30 degrees relative to the remainder of the bottom wall 44. Likewise, the angled portion 44*a* is angled relative to the portion of the bottom wall 44 proximate the Wailing edge 52*b*. At the same time, the trailing edge 52*b* is positioned below the leading edge 52*a*. It can also be seen that the exit orifice 52 generally exits in a plane that is non-parallel to the plane of the remainder of the bottom wall 44*a*. As shown, the exit orifice 52 exists in a plane generally aligned with the plane formed by the angled portion 44*a* of the bottom wall 44.

Figure 3:
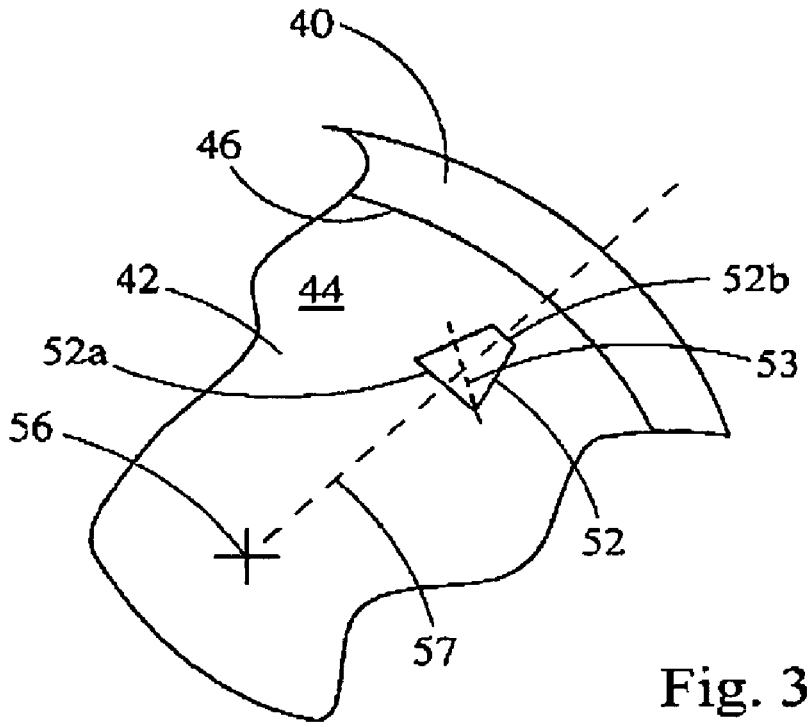
FIG. 3 is a plan view, partially cut-away, of the metering plate forming a portion of the nozzle depicted in FIGS. 1 and 2.

As a result of the structure of the exit cavity 50 depicted in FIG. 2, fuel flowing through the exit cavity 50 is forced radially outwardly, and follows a overall flow path having a exit axis 55. It can be seen at the exit axis 55 is tilted radially relative to the longitudinal axis 15. In this manner, the spray angle of the fuel delivered to the engine cylinder 10 can be increased. Likewise, the vertical position mismatch of the leading and trailing edges 52*a*, 52*b* (or stated another way the tilted plane of the exit orifice 52) increases the turbulence of the fuel flowing through the nozzle cavity 42 and exit cavity 50 to further increase atomization of the fuel Turning now to FIG. 3, another unique feature of the metering plate 40 is depicted which increases the turbulence of the fuel and thereby enhances atomization. In particular, it can be seen that the leading edge 52*a* is larger than the trailing edge 52*b*. That is, the leading edge 52*a* spans a distance which is greater than the distance spanned by the trailing edge 52*b*. Although the leading and trailing edge 52*a* and 52*b* have been shown as straight in FIG. 3, it will be recognized by those skilled in the art that the edges could take other non-linear shapes such as curved. Likewise, the exit orifice 52, has been shown as a trapezoid although numerous other shapes could be used, as will be discussed in further detail below. The exit orifice 52, in the shape of a trapezoid, thus has an axis of symmetry 53 which is shown aligned and generally parallel to the radial axis 57 of the instant exit orifice 52. By utilizing the trapezoidal shaped orifice 52, and in particular a leading edge 52*a* which is larger than a trailing edge 52*b*, additional turbulence is added to the fuel flowing through the exit cavity 50, thereby enhancing the atomization of fuel delivered to engine cylinder 10.

Figure 4:
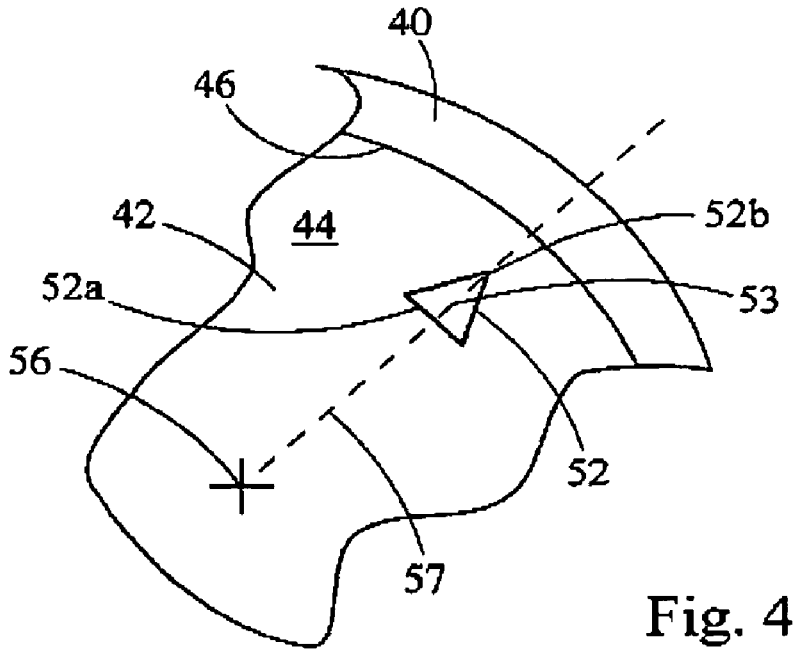
FIG. 4 is a plan view, partially cut-away, of another embodiment of the metering plate forming a portion of the nozzle depicted in FIGS. 1 and 2.

As shown in FIG. 4, the exit orifice 52 may be triangular in shape. The trailing edge 52*b* in this case is essentially a point which is clearly smaller than the leading edge 52*a*. It will be recognized that numerous other shapes can be used including those which are oblong such as ellipsoids, ovals, egg-shaped orifices (as shown in FIG. 6) and infinitely many other shapes which have a leading edge that is larger than a trailing edge. Likewise, when the shape of the exit orifice 52 has an axis of symmetry, the axis of symmetry is preferably aligned with the radial axis 57 although such an orientation is not necessary.

Figure 5:
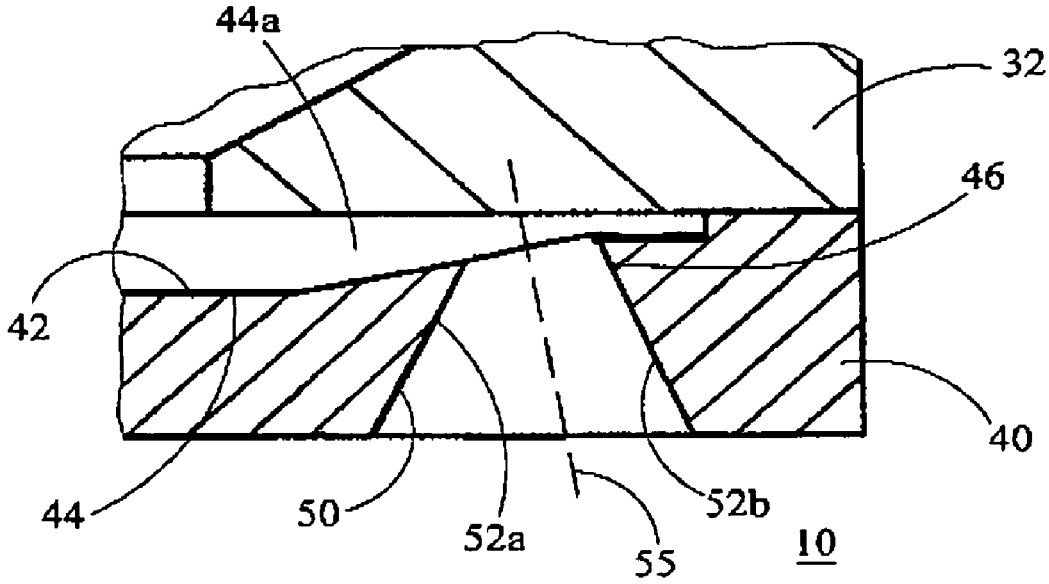
FIG. 5 is an enlarged cross-sectional view, partially cut-away, of an alternate embodiment of the metering plate depicted in FIGS. 1 and 2.

Turning now to FIG. 5, another embodiment of the metering plate 40 is shown which is similar to the embodiment depicted in FIGS. 1 and 2. However, it will be noted that the angled portion 44*c* proximate the leading edge 52*a* is sloped upwardly relative to the remainder of the bottom wall 44. At the same time, the trailing edge 52*b* is positioned above the leading edge 52*a*. As in the prior embodiment, this structure results in fuel flowing through the exit cavity 50*c* being directed radially outwardly and following exit axis 55*c* which is tilted radially outwardly relative to the longitudinal axis 15. At the same time, additional turbulence is introduced into the fuel flowing through this formation of the exit cavity 50*c*, thereby enhancing atomization of the fuel delivery to the engine cylinder 10. Further, the structure and orientation of each exit cavity, in concert with the plurality of exit cavities, enhances the spray angle and control over the direction of the spray.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A nozzle for a low pressure fuel injector, the fuel injector delivering fuel to a cylinder of an engine, the nozzle comprising:

a nozzle body defining a valve outlet and a longitudinal axis;

a metering plate connected to the nozzle body and in fluid communication with the valve outlet;

the metering plate having a bottom wall defining a nozzle cavity receiving fuel from the valve outlet;

the metering plate defining a plurality of exit cavities receiving fuel from the nozzle cavity, each exit cavity radially spaced from the longitudinal axis and oriented along a radial axis, each exit cavity meeting the nozzle cavity at an exit orifice; and each exit orifice being formed in the bottom wall and having a leading edge and a trailing edge, the trailing edge spaced radially outwardly from the leading edge, the leading edge extending a distance larger than a distance spanned by the trailing edge.

2. The nozzle of claim 1, wherein the leading edge extends perpendicular to the radial axis.

3. The nozzle of claim 1, wherein each exit orifice is symmetrical about a symmetry axis.

4. The nozzle of claim 3, wherein each symmetry axis is aligned with the radial axis.

5. The nozzle of claim 1, wherein at least one exit orifice is triangular.

6. The nozzle of claim 1, wherein at least one exit orifice is trapezoidal.

7. The nozzle of claim 1. wherein at least one exit orifice is oblong.

8. The nozzle of claim 1, wherein a portion of the bottom wall in the area adjacent the leading edge is angled downwardly.

9. The nozzle of claim 8, wherein the angled portion adjacent the leading edge is angled relative to a portion of the bottom wall adjacent the trailing edge.

10. The nozzle of claim 8, wherein the angled portion adjacent the leading edge is angled relative to the remainder of the bottom wall.

11. The nozzle of claim 1, wherein the exit orifice exists in a plane non-parallel to a plane defined by the remainder of the bottom wall.

12. The nozzle of claim 1, wherein the trailing edge positioned below the leading edge.

13. The nozzle of claim 1, wherein each exit orifice exists in a plane defined by the bottom wall.

14. The nozzle of claim 1, wherein the bottom wall exists on the radially inward side of the leading edge.

15. A nozzle for a low pressure fuel injector, the fuel injector delivering fuel to a cylinder of an engine, the nozzle comprising:

a nozzle body defining a valve outlet and a longitudinal axis;

a metering plate connected to the nozzle body and in fluid communication with the valve outlet;

the metering plate having a bottom wall defining a nozzle cavity receiving fuel from the valve outlet;

the metering plate defining a plurality of exit cavities receiving fuel from the nozzle cavity, each exit cavity radially spaced from the longitudinal axis and oriented along a radial axis, each exit cavity meeting the nozzle cavity at an exit orifice; and each exit orifice having a leading edge and a trailing edge, the trailing edge spaced radially outwardly from the leading edge, the trailing edge being positioned above or below the leading edge, a portion of the bottom wall in the area adjacent the leading edge being angled.

16. The nozzle of claim 15, wherein the angled portion adjacent the leading edge is angled downwardly or upwardly relative to the portion of the bottom wall adjacent the trailing edge.

17. The nozzle of claim 15, wherein the angled portion adjacent the leading edge is angled relative to the remainder of the bottom wall.

18. The nozzle of claim 17, wherein the portion adjacent the leading edge is angled by about 20 to 30 degrees.

19. The nozzle of claim 15, wherein the exit orifice exists in a plane non-parallel to the plane of the remainder of the bottom wall.

20. The nozzle of claim 15, wherein the leading edge extends a distance larger than a distance spanned by the trailing edge.

21. A nozzle for a low pressure fuel injector, the fuel injector delivering fuel to a cylinder of an engine, the nozzle comprising:

an injector body defining a valve outlet and a longitudinal axis;

a metering plate connected to the injector body and in fluid communication with the valve outlet;

the metering plate having a bottom wall defining a nozzle cavity receiving fuel from the valve outlet;

the metering plate defining a plurality of exit cavities receiving fuel from the nozzle cavity, each exit cavity radially spaced from the longitudinal axis and oriented along a radial axis, each exit cavity meeting the nozzle cavity at an exit orifice; and each exit orifice having a leading edge and a trailing edge, the trailing edge spaced radially outwardly from the leading edge, the leading edge extending a distance larger than a distance spanned by the trailing edge, a portion of the bottom wall in the area adjacent the leading edge being angled downwardly.

* * * * *